United States Patent [19]

Gamburd

[11] 4,248,007

[45] Feb. 3, 1981

[54] FLYING TOY

[76] Inventor: Samuel Gamburd, Wareham, Mass. 02571

[21] Appl. No.: 93,223

[22] Filed: Nov. 13, 1979

[51] Int. Cl.[3] ..... A63H 27/00

[52] U.S. Cl. ..... 46/79; 46/74 R; 244/34 A; 244/16

[58] Field of Search ..... 46/76 R, 79, 76 A, 77, 46/74 R, 74 A, 78, 81; 244/34 A, 153 R, 154, 16

[56] References Cited

U.S. PATENT DOCUMENTS

| | | | |
|---|---|---|---|
| 1,775,252 | 9/1930 | Pennick | 46/76 R |
| 3,017,139 | 1/1962 | Binder | 244/34 A X |
| 3,154,269 | 10/1964 | Musil | 244/34 A |
| 3,600,842 | 8/1971 | Bryman | 46/79 X |
| 3,714,734 | 2/1973 | Livingston | 46/76 R |
| 3,903,639 | 9/1975 | Howell | 46/78 |
| 3,946,519 | 3/1976 | Vadik et al. | 46/79 |

FOREIGN PATENT DOCUMENTS

| | | | |
|---|---|---|---|
| 738466 | 12/1932 | France | 244/34 A |

*Primary Examiner*—Robert Peshock
*Assistant Examiner*—Mickey Yu
*Attorney, Agent, or Firm*—Kerkam, Stowell, Kondracki & Clarke

[57] ABSTRACT

A toss-type flying toy has at least one tubular aerodynamic member positioned adjacent the plane of a mid fuselage planar generally circular horizontal wing. The flying toy also includes a forwardly positioned horizontal circular lifter, upper and lower vertical guide fins, a horizontal guide fin and a vertical rudder with a generally horizontal stabilizer. Positioning of certain of the aerodynamic control elements enable a flight path to be determined prior to launch.

5 Claims, 6 Drawing Figures

FLYING TOY

DESCRIPTION

Technical Field

The present invention relates to toss-type flying toys, and in particular to such flying toys having positional aerodynamic elements whereby a flight path can be determined prior to launch.

BACKGROUND OF PRIOR ART

Toss-type and small motor powered flying toys are well known in the art, including some that have one or more tubular aerodynamic flight control surfaces. Exemplary of such prior art devices are the tubular wing toys disclosed in U.S. Pat. Nos. 3,903,639-Howell, and 3,946,519-Vadik et al, and the generally flat, oval wing flying toy disclosed in U.S. Pat. No. 1,509,018 to Morton.

The novel flying toy of this invention combines features of such prior art devices into a simple, inexpensive toy having adjustable aerodynamic surfaces, the combined adjustment of which enables the flying toy to perform a number of flight maneuvers.

BRIEF SUMMARY OF INVENTION

The toy flying apparatus may be generally defined as comprising a plurality of elongated strips which are taped together to form a boom type fuselage. The boom type fuselage slidably supports, from the forward end rearwardly, a nose weight; a planar, horizontal generally circular lifter; a planar generally circular wing and at least one tubular aerodynamic member; first and second vertical guide fins; a vertical rudder supporting a generally horizontal stabilizer; and a rear horizontal guide fin.

Throughout the specification and claims, the terms rear, mid, forward, vertical and horizontal are to be read in respect to the longitudinal axes of the boom type fuselage when the fuselage is in normal forward horizontal flight.

BRIEF DESCRIPTION OF DRAWINGS

The invention will be more particularly described in reference to the accompanying drawing wherein.

DETAILED DESCRIPTION OF INVENTION

Figure 1:
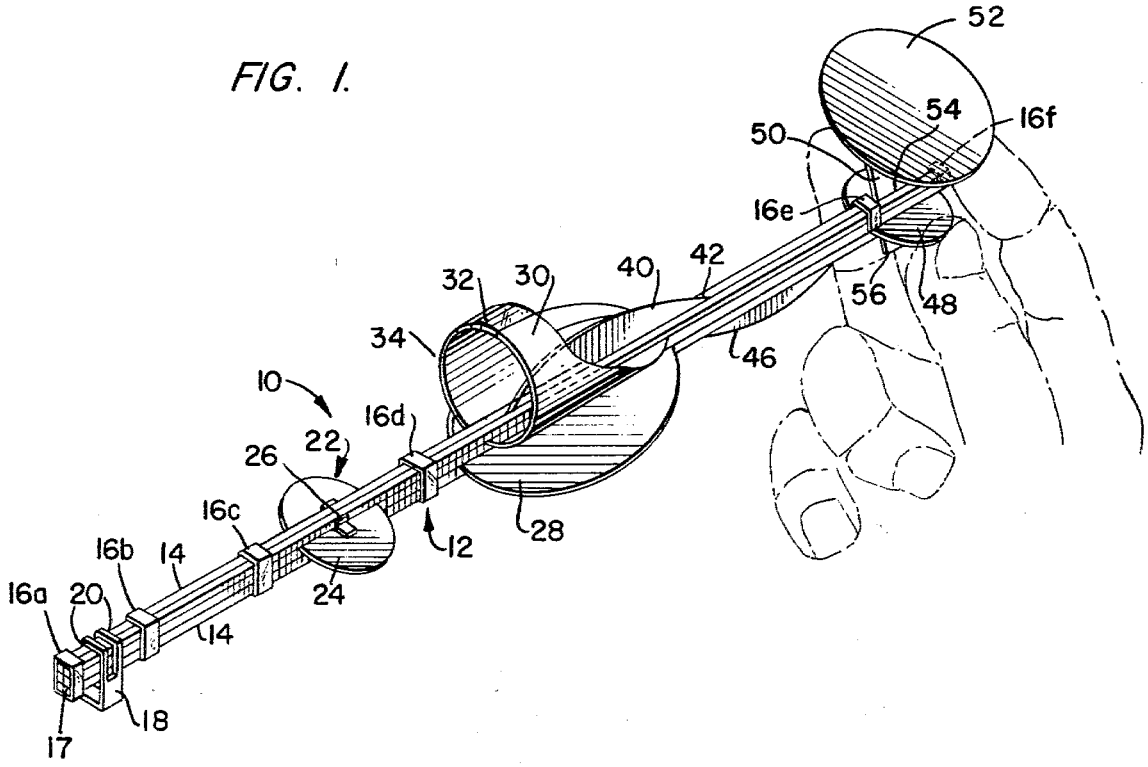
FIG. 1 is a prospective view of one form of the toy flying apparatus of the invention.
Figure 2:
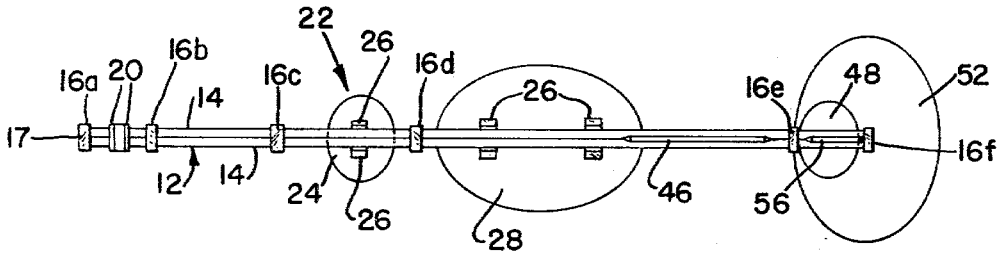
FIG. 2 is a bottom plan view of the apparatus.
Figure 3:
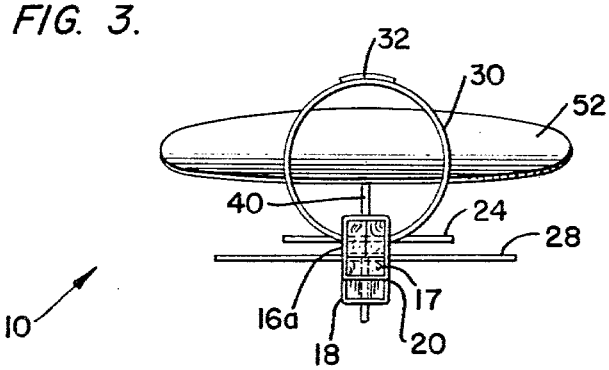
FIG. 3 is a front view of the structures shown in FIGS. 1 and 2.

Referring particularly to FIGS. 1-3, 10 generally designates a form of the toy flying apparatus of the invention.

The flying toy consists of a fuselage generally designated 12 composed of a plurality of side-by-side elongated strips 14. In a preferred embodiment of the invention six strips 14 are employed in construction of the fuselage with two rows of three strips each in side-by-side relationship. For a small toss-type toy strips 14 comprise 1/16×1/16 balsa wood. The strips are not glued together but, as to be more fully described hereinafter, tapes of a commercial type are wrapped about the fuselage as indicated at 16*a*, 16*b*, 16*c*, 16*d*, and 16*e*, etc. The positioning of the tapes are such that the strips 14 are held in the desired configuration without materially limiting positioning of the other elements forming the toy flying apparatus.

Further, in a preferred embodiment, each of the strips is approximately 10 inches in length. The other dimensions hereinafter set forth for this embodiment are all predicated on the fuselage constructed and dimensioned as hereinbefore set forth. Commencing at the forward end 17 of the flying apparatus, and progressing rearwardly, the other elements forming the apparatus will now be described.

Adjacent the forward end 17 is slidably mounted a weight 18 having a pair of fine wire or thread connecting means 20 which are joined to the weight and passed around the fuselage 12 so that the position of the weight 18 relative to the forward end 17 of the fuselage may be readily varied. A weight in the order of 1.45 to 1.01 grams has been found to provide adequate operation with unmotorized forms of the invention.

At position 22 is mounted a generally circular front horizontal planar lifter generally designated 24. Mounting of the lifter 24 is accomplished by inserting the lifter between the top most row of strips 14 and the row therebelow. The lifter 24 is maintained in its position 22 by small strips of tape such as indicated at 26. Employing the small strips of tape 26 permits ready repositioning of the forward lifter 24 in order to vary the flight plan of the flying apparatus as to be more fully described hereinafter. The lifter 24 with a diameter of about 1 inch provides satisfactory results.

Rearwardly of the front horizontal circular lifter is mounted the wing 28. The wing 28, like the front lifter, is formed of paper or plastic, and the wing 28 is oval with a major diameter running parallel to the longitudinal axes of the fuselage 12 of about 3 inches and a minor diameter of about 2½ inches.

The wing is mounted to the fuselage 12 by inserting the wing in a slot formed between the lower most pair of strips 14 and the next higher strip as illustrated in the drawing. The wing 28 is releasably anchored to the fuselage by small pressure sensitive adhesive strips. Mounted above the wing is a tubular aerodynamic member 30. The tubular aerodynamic member is formed from a triangular piece of paper or plastic, having a base 3½ inches long and a height of about 1¾ inches.

The triangular piece of paper or plastic is then folded upwardly and taped to provide a tube having a diameter of about ¾ of an inch.

The tubular aerodynamic member 30 is assembled to the fuselage by inserting the paper, or plastic triangle between the first and second rows of strips 14 in the manner of assembling the forward planar circular lifter 24, and then taping the upper ends of the triangular paper, or plastic member one to the other by tape generally designated 32, as more particularly noted from FIG. 1, the tubular aerodynamic member 30 is positioned with its leading edge 34 about 5½ inches from the front end 17 of the fuselage 12.

Above a major portion of the wing 28 and within a portion of the tubular aerodynamic member 30 is an upper vertically positioned guide fin 40 having a curvilinear top surface 42 and a straight bottom edge (not shown). The member 40 is attached to the fuselage 12 by inserting the lower straight edge between the pair of top strip members 14 and applying tape between the guide fin and the strip members. A guide fin 40 having a length of about 2 inches and a height of about ½ inch provides satisfactory results.

The boom or fuselage 12 also supports a lower vertical guide fin 46 having dimensions the same as guide fin 40 and maintained on the fuselage by inserting the straight edge between the pair of strip members 14 with the flat edge of the guide fin directed upwardly.

The guide fin 46 may be taped to the fuselage or both guide fins 40 and 46 may be glued to the fuselage taking care that in gluing, repositioning of the wing 28, the tubular aerodynamic member 30, or the rudder, and horizontal stabilizer are not immobilized. If the upper and lower vertical guide fins are glued to the fuselage, positioning the guide fins with the centers thereof approximately 5⅝ and 6⅞ inches respectively from the forward end 17 of the fuselage provides satisfactory results.

The assembly also includes a horizontal planar generally circular guide fin 48. The guide fin is secured to the rear end of the fuselage by gluing or tapes following insertion of the guide fin between the upper surface of the lower most strips 14 and the next upwardly succeeding strips. A guide fin having a diameter of about one inch has been found to be satisfactory.

Also at the rearward end of the fuselage 12 is mounted a vertically extending rudder 50 and a stabilizer 52. The stabilizer 52 is attached to the rudder 50 by pressure sensitive tapes and the stabilizer 52 is generally oval in shape with its major diameter being approximately about 2½" and its minor diameter lying in the plane of the fuselage of about 1¾".

The vertically positioned rudder 50 is inserted with a portion thereof designated 54 projecting above the upper surface of the fuselage 12, and a portion 56 projecting below the bottom of the fuselage 12. In view of the relative positions of the rudder 50 and the rear horizontal guide fin 48, either the guide fin 48 or the rudder 50 are formed in two pieces so that there will be no interference in inserting these elements in spaces between the strip members 14.

Referring now to the second form of applicant's invention, the flying apparatus is substantially identical to that previously described but for the form and configuration of the tubular aerodynamic members and the wing of the craft. Thus, the flying machine 10' has a fuselage 12', nose weight 18', a forward end 17', a front horizontal planar circular lifter 24', an upper vertical guide fin 40', a lower vertical guide fin 46', a vertical stabilizer 50', a generally horizontal stabilizer 52', a lower portion of the horizontal rudder 56', and a rear horizontal guide fin 48' all of which are identical to the equivalent structures described in reference to FIGS. 1–3.

The second form of applicant's invention has a novel wing 70 and novel tubular aerodynamic members as to be described hereinafter.

Figure 4:
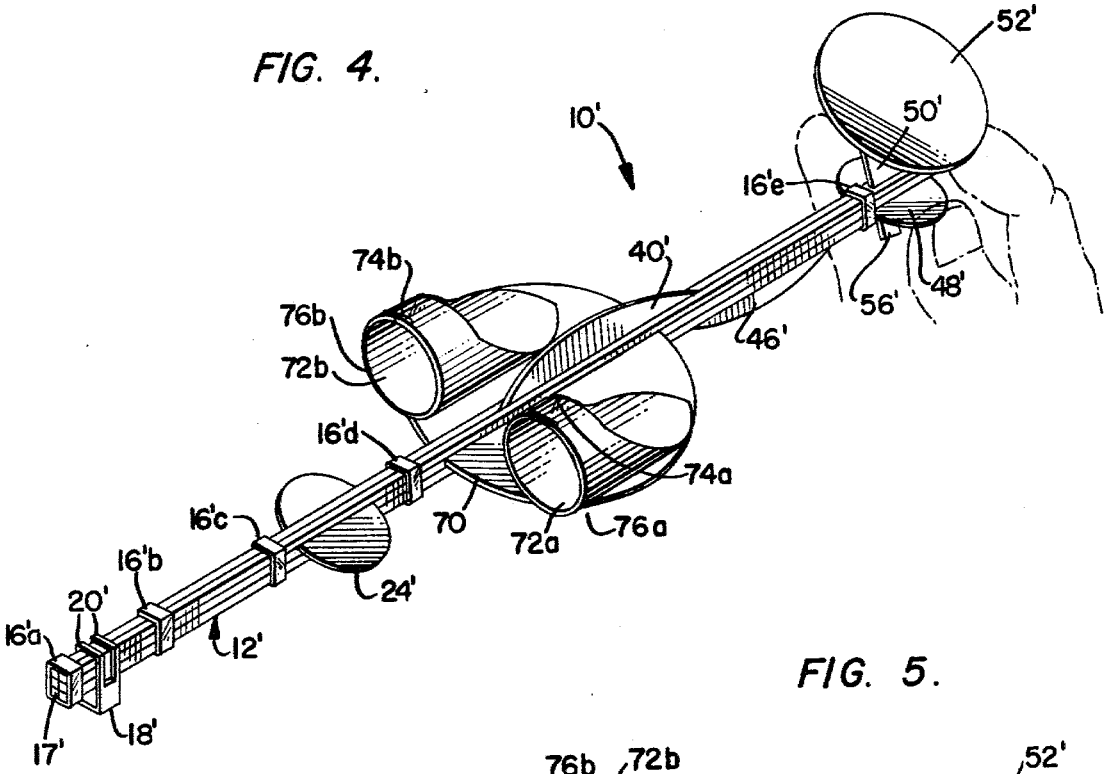
FIG. 4 is a prospective view like FIG. 1 of a modified form of the present invention.
Figure 5:
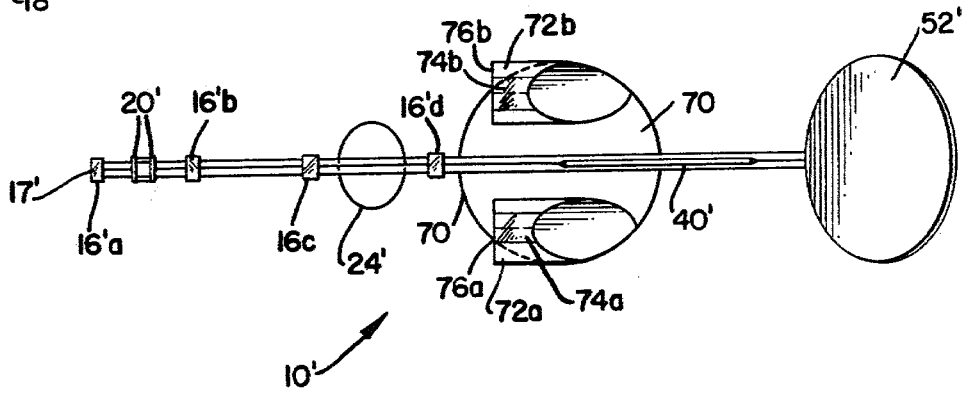
FIG. 5 is a top view of the structures shown in FIG. 4.
Figure 6:
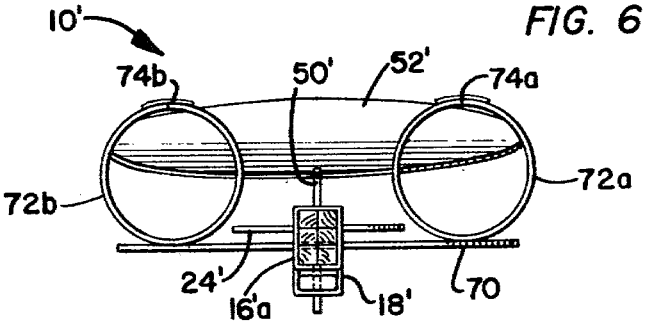
FIG. 6 is a front view of the form of the invention shown in FIGS. 4 and 5.

In this form of the invention the wing 70 is circular in plan and has a diameter of about 2½". Mounted adjacent the two lateral extensions of the wing 70 are a pair of tubular aerodynamic members **72*a* and 72*b*. The tubular aerodynamic members 72*a* and 72*b* are formed from a triangular sheet of paper or the like rolled and taped as at 74*a* and 74*b*. The pair of tubular aerodynamic members are attached to the circular wing 70 such that a portion 76*a* and 76*b* project outwardly from the circular dimensions of the wing 70 as more clearly illustrated in FIGS. 4 and 5. The size of the tubular aerodynamic members 72*a* and 72*b*** may be identical to that described in reference to the first form of the invention. Employing the pair of tubular aerodynamic members increases the lift of the flying machine over that illustrated in the first form of the invention.

The stabilizer 52 is preferably mounted at an angle of about 15° to the horizontal, however, angles of from about 10° to about 30° will provide satisfactory results.

OPERATION

Operation of the flying apparatus will be described in reference to the first form of applicant's invention, it being recognized that in the second form, substantially identical positioning of the various components will result in similar flight characteristics.

Starting with the flight elements positioned as disclosed herein the following adjustments may be made:

For high loops the rudder assembly 50–52 is moved ⅛ inch towards the nose 17;

For shorter loops and longer glides the angle of rudder assembly 50–52 is decreased;

For higher flights nose weight 18 is moved forwardly, however, rearward movement avoids a nose dive and increases angle of lift;

To create a slalom flight effect, the tubular member 30 is moved to the left or right; and The vertical rudder 50 is moved up or down and the generally horizontal stabilizer 52 is moved opposite to the movement of the tubular member 30, that is, to the right or left.

To those skilled in the art it will be recognized that various other combinations of movements of the flight elements will create novel and programmable flight patterns.

It will also be recognized by those skilled in the art, while the toy flying apparatus has been described in reference to a toss-type device, the flying machine may be modified to include other forms of motive powers such as electric, gasoline, or rubber-band driven propellors, or jet effects produced by burning gases or expanding compressed gases, without departing from the scope of the present invention.

STATEMENT OF INDUSTRIAL APPLICATION

A toss or motor-driven flying toy is provided having a plurality of positional aerodynamic elements to permit the operator to ascertain prior to launch a general flight path for the toy.

I claim:

1. A toy flying apparatus comprising:

a plurality of side-by-side elongate strips;

releasable means maintaining said strips in said side-by-side relation to form a boom type fuselage;

a planar mid fuselage generally circular horizontal wing releasably secured to the boom type fuselage;

at least one tubular aerodynamic member positioned adjacent the plane of said wing with the axis of the tubular member parallel to the longitudinal axis of the fuselage;

first, second and third guide fins projecting from the boom type fuselage respectively, vertically upwardly, vertically downwardly and horizontally in respect to a horizontal flight path of the flying toy;

a planar horizontally positioned lifter releasably connected to the fuselage forwardly of the wing;

a rudder having a generally horizontal stabilizer mounted adjacent the rearward end of the boom type fuselage; and selectively movable weight means carried adjacent the forward end of the boom type fuselage.

2. The toy flying apparatus as defined in claim 1 wherein there are a pair of tubular aerodynamic members positioned adjacent the plane of the wing.

3. The toy flying apparatus as defined in claim 2 wherein the pair of tubular aerodynamic members are positioned in parallel spaced arrangement on the wing.

4. The toy flying apparatus as defined in claim 1 wherein there is a single tubular aerodynamic member with the longitudinal axis of the tubular member positioned parallel to the axis of the boom type fuselage.

5. The toy flying apparatus as defined in claim 1 wherein the rudder assembly is placed at angles from 10° to about 30° to the horizontal axis of the boom type fuselage.

* * * * *